United States Patent [19]

Karpen

[11] 4,088,585

[45] May 9, 1978

[54] LUBRICANT CONTAINING $MoS_2$, LUBRICATING PROCESS, AND LUBRICATED WORKPIECE

[75] Inventor: William L. Karpen, Reading, Pa.

[73] Assignee: Carpenter Technology Corporation, Reading, Pa.

[21] Appl. No.: 631,732

[22] Filed: Nov. 13, 1975

[51] Int. Cl.[2] ..... C10M 1/10; C10M 3/02; C10M 5/02; C10M 7/04

[52] U.S. Cl. ..... 252/28; 72/42; 252/49.5

[58] Field of Search ..... 252/12, 12.2, 12.4, 252/12.6, 28, 49.5; 72/42

[56] References Cited

U.S. PATENT DOCUMENTS

| | | | |
|---|---|---|---|
| 1,871,939 | 8/1932 | Adams | 252/49.5 |
| 2,619,458 | 11/1952 | McBride | 252/25 |
| 2,998,328 | 8/1961 | Murger et al. | 427/403 |
| 3,079,204 | 2/1963 | Lamson et al. | 252/28 |
| 3,242,076 | 3/1966 | Hagan | 252/12 |
| 3,244,625 | 4/1966 | Silwones | 252/28 |
| 3,390,079 | 6/1968 | Utakoji et al. | 252/12 |
| 3,915,870 | 10/1975 | Brown | 252/28 |
| 4,001,125 | 1/1977 | Newton | 252/49.5 |

*Primary Examiner*—Delbert E. Gantz
*Assistant Examiner*—Irving Vaughn
*Attorney, Agent, or Firm*—Edgar N. Jay

[57] ABSTRACT

A dry-film, water-base lubricant is provided for coating metallic workpieces for use in cold forming operations comprising $MoS_2$ powder, hydroxyethyl cellulose, and sodium and/or potassium silicate. A process for applying this lubricant and a lubricated workpiece are also provided.

34 Claims, No Drawings

LUBRICANT CONTAINING $MoS_2$, LUBRICATING PROCESS, AND LUBRICATED WORKPIECE

BACKGROUND OF THE INVENTION

This invention relates to the lubrication of metallic workpieces for forming processes and, more particularly, to a dry-film, water-base lubricant comprising finely divided molybdenum disulfide ($MoS_2$) powder; a workpiece coated with this lubricant; and the process for coating workpieces with this lubricant.

In forming operations such as heading, extrusion, or wire drawing, the workpiece being formed is forced into face-to-face contact with a die under very high pressure and pressed or drawn into a desired shape and size, during which the contacted surfaces of the workpiece and the die move laterally with respect to each other. Although some of the more ductile metals can be successfully formed without a lubricant, most metals to be headed, drawn, or extruded are lubricated to prevent galling of the work metal or the dies, sticking in the dies, and excessive die wear.

The lubrication of hard-to-work metals in cold heading processes has been a particularly difficult problem. Cold heading is a cold (less than about 350° F or 177° C) forming process in which the force developed by one or more strokes of a heading tool is employed to upset, or displace, the metal in a portion of a wire or rod blank to form a section of different contour or, more commonly, of larger cross section than the original. Heretofore, a hard-to-work metal, such as for example stainless steel, which is to be cold headed has been usually electroplated with a soft metal, such as copper, which acts as a cold heading lubricant, often with an additional coating of an oil or $MoS_2$ powder lubricant. After fabrication, the copper coating usually must be removed, most commonly by treating the workpieces in heated dilute nitric acid.

Until recently the copper-bearing nitric acid waste solution was dumped, either with or without neutralization, into landfills and streams. These disposal practices are no longer permitted in many jurisdictions because of the toxicity of the copper compounds. Therefore, disposal of the copper waste solution has become a very costly problem.

$MoS_2$ powder is a dry lubricant of such low toxicity that it is commonly used on chains and bearing surfaces in food processing equipment such as ovens. Because of its low toxicity, the disposal of molybdenum compounds into landfills or waterways is permitted so that disposal of an $MoS_2$ lubricant after removal from the work product can be economically carried out.

Although $MoS_2$ powder has long been used as a lubricant, there are a number of problems in using this material on production scale forming such as heading or drawing operations. In the case of multistage forming operations, enough $MoS_2$ must be put on the workpiece to keep it lubricated when under extremely high pressure, and that $MoS_2$ must be tightly adhered to the workpiece. Further, the $MoS_2$ coating must be uniformly applied so that all working surfaces are adequately protected, and so that the workpiece is uniformly sized to fit into the dies. In addition, the coating should be economically applied at production rates to feedstock, particularly to wire feedstock.

Since $MoS_2$ powder will not adhere well by itself to a metal workpiece, it has been found desirable to coat the workpiece by mixing $MoS_2$ powder with other materials which will form a uniform and adherent coating or film on the metal. One method of applying $MoS_2$ powder is by mixing it with grease and oils as described in Cooper et al U.S. Pat. No. 2,156,803, May 2, 1939, or by mixing it into a water-based grease as described in Freier U.S. Pat. No. 3,249,538, May 3, 1966, or as in Brown et al. U.S. Pat. No. 3,350,307, Oct. 31, 1967. However such greases do not adhere well enough to workpieces and are quickly rubbed off in multistage forming operations.

Another method is to form a dry film coating containing the $MoS_2$ powder on the surface of the workpiece. This can be done by applying a suspension of $MoS_2$ powder in a carrier liquid to the metal surface and then drying off the carrier to leave a dry film which should include agents to adhere the $MoS_2$ powder to the metal substrate. For ease of handling and economy, water has been found to be an excellent carrier liquid. Since water will not wet the surface of $MoS_2$ particles, it is necessary to include a water soluble wetting agent in such a lubricating composition.

McBride U.S. Pat. No. 2,619,458, Nov. 15, 1952, describes a method of applying a dry lubricating film containing $MoS_2$ powder to bearing surfaces. The method comprises mixing the $MoS_2$ into an aqueous suspension with a "suspending" agent, a "wetting" agent, and a chromate "corrosion inhibitor". The "suspending" agents are water soluble materials among which is included methyl and ethyl cellulose. However, as will be discussed further hereinbelow, that coating does not provide the unique properties of the lubricant of the present invention and includes one of several chromate compounds in all of its formulations which are highly toxic and subject to strict disposal regulations.

Silwones U.S. Pat. No. 3,244,625, Apr. 5, 1966, relates to a dry film lubricating composition comprising $MoS_2$ powder, water soluble silicates as "film forming compounds", and toxic "adhering agents" comprising a phosphate and either borate or chromate salts, which after application is baked for several hours. The lubricant is intended for use at elevated temperatures up to about 2000° F (1093° C) but leaves much to be desired for cold forming operations.

SUMMARY OF THE INVENTION

It is, therefore, a principal object of this invention to provide a dry film lubricant comprising $MoS_2$ powder which strongly adheres to the surface of a metallic workpiece.

It is a further object of this invention to provide a method of applying such a dry film lubricant from a water-base suspension.

A further object is to provide workpieces for cold heading and drawing operations which are coated with an easily disposable, effective lubricant.

In accordance with a preferred embodiment of the present invention, finely divided $MoS_2$ powder is mixed in water with water soluble hydroxyethyl cellulose and sodium or potassium silicate. A small amount of pine oil may also be added as a biocide and defoaming agent because of the susceptibility of hydroxyethyl cellulose to bacterial attack and its tendency to foam excessively, particularly since this mixture is preferably continuously stirred to maintain homogeneity. The mixture is applied to workpieces which are then dried to leave a tough dry lubricant film strongly adhered to the the surfaces thereof.

DESCRIPTION OF THE PREFERRED EMBODIMENTS

In the lubricant of the present invention, finely divided $MoS_2$ powder is bound to a metallic substrate in a dry film formed by sodium or potassium silicate and hydroxyethyl cellulose. Films comprising more finely divided $MoS_2$ tend to adhere better than those comprising less finely divided powders. Severe forming processes, such as multistage heading, require a more tightly adhered coating than less severe processes such as some drawing or single or double stage heading operations. The $MoS_2$ powder used in all of the following examples was that manufactured by the Climax Molybdenum Company, designated as "Suspension Grade Molysulfide", having a typical average particle size (by Fisher) of 0.35 micron, a maximum average particle size of 0.45 micron, and a typical average surface area (BET) of 13.0 square meters per gram. The dry film comprising this powder had excellent adherence through very severe heading operations comprising six or seven stages, and thus the preferred $MoS_2$ powder for use in the lubricant of this invention is that of about this or greater fineness. Lubricants of this invention, comprising less finely divided $MoS_2$, have been successfully used in less severe forming operations and for such operations, finely divided $MoS_2$ having a maximum average particle size of about 0.85 micron or up to about 1 micron and even larger may be used when satisfactory adherence can be had.

The amount of $MoS_2$ powder needed in the lubricant bath depends on how the workpiece is to be coated and the severity of the forming operations to which the lubricated workpiece will be subjected. As will be discussed below, these factors also affect the amounts of the other ingredients in the bath as well. When a two stage coating procedure is used, a minimum of about 5 weight percent (w/o) $MoS_2$ is needed to assure adequate lubrication of the workpiece in severe forming operations, such as multistage heading. If more coats of the lubricant are applied, then lesser amounts of $MoS_2$ can be tolerated, and if only one coat is applied, then a minimum of about 10 w/o $MoS_2$ should be used. Not more than about 30 w/o $MoS_2$ powder should be used, since the use of excessive $MoS_2$ results in a film which tends to flake off the work surface. It is to be noted that throughout this application by percent is intended weight percent.

The second major component of the lubricant of this invention is a nonionic hydroxyethyl cellulose which disperses rapidly and dissolves easily in water, and which at necessary concentration does not make the lubricant bath too viscous. It acts as a wetting agent for the $MoS_2$ powder which is not normally wetted by water and as a bonding agent for the dry film. A preferred hydroxyethyl cellulose composition is manufactured by Hercules, Inc. and designated as Natrosol 250 LR. Natrosol products are a family of nonionic water-soluble polymers of the general structure:

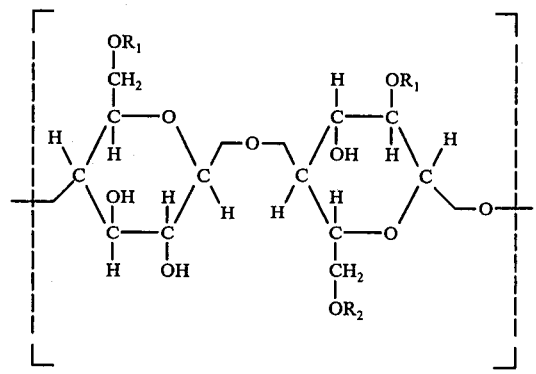

in which $R_1$ is $=C_2H_4O—C_2H_4OH$ and $R_2$ is $=C_2H_4$-OH. Natrosol 250 LR powder has been treated to provide fast dispersion and easier dissolving in water, and a 5% aqueous solution has a Brookfield Viscosity at 25° C of 75–150 centipoises.

Enough hydroxyethyl cellulose must be included so as to wet and bind an adequate amount of $MoS_2$, but if the hydroxyethyl cellulose concentration is too high, then the bath will become too viscous which makes uniform coating difficult and results in too thick films. For the Natrosol 250 LR hydroxyethyl cellulose about 0.2% to 3% is used. The amounts of other cellulosic products would depend, among other things, on their solution viscosities.

The third major component of the lubricant of this invention is an additional bonding agent comprising sodium or potassium silicate water solutions, commonly known as water glass. Silicate solutions comprise combinations of silicon dioxide ($SiO_2$) and sodium oxide ($Na_2O$) or potassium oxide ($K_2O$) dissolved in water, and are characterized by both the concentrations of the two components and by the ratio of the $SiO_2$ to the $Na_2O$ or $K_2O$.

The silicate works together with the hydroxyethyl cellulose to provide unique properties which cannot be obtained from either alone. Although a one weight percent concentration of hydroxyethyl cellulose was found adequate to wet the desired amount of $MoS_2$ powder in water, the density of the film formed therefrom was only 3 to 5 mgs/in$^2$ (0.5 to 0.8 mgs/cm$^2$), well below the preferred coating density of about 10 to 15 mgs/in$^2$ (1.6 to 2.3 mgs/cm$^2$). Since increasing the concentration of hydroxyethyl cellulose increases both the coating density and the mixture viscosity, a mixture containing enough hydroxyethyl cellulose to obtain the preferred coating density was found to be too viscous to properly coat a workpiece. The use of a silicate with the hydroxyethyl cellulose produces a coating with the preferred density from a mixture of suitable viscosity.

Enough silicate solution must be used in the lubricant to achieve the desired dry film coating. However, too much silicate results in very brittle coatings at cold forming temperatures which tend to crack and flake. Acceptable results have been obtained by using about 2% to 21% of a wide range of commercially available silicate solutions which varied from about 30 to 55% solute (45 to 70% water), and, therefore, the silicate content of the lubricant bath should be about 0.6%-12%. Since these solutions are mixed with additional water in preparing the lubricant bath, it should be obvious that more dilute silicate solutions could be used by adding more solution and less make-up water. More concentrated silicate solutions may also be used, but they tend to be too viscous and are therefore difficult to handle.

The ratio of $SiO_2$ to $Na_2O$ or $K_2O$ in these solutions varied from about 1.5 to 4 and was not found to be too critical. Since the solution is greatly diluted with make-up water, the viscosity is not critical at all, with viscosities varying from 40–70,000 cP giving acceptable results.

A preferred sodium silicate solution for this invention is manufactured by the Philadelphia Quartz Co. under the designation "RU", and in the following examples, all sodium silicate solution concentrations are weight percents of RU solution. This solution contains about 33.2 w/o $SiO_2$ and 13.85 w/o $Na_2O$, for an $SiO_2$ to $Na_2O$ ratio of 2.40, and about 52.95 w/o water, and has a viscosity of 2,100 centipoises at 68° F (20° C). Although other silicate solutions also gave comparable results, for best results, different concentrations may have to be used in specific formulations from those described below for RU solution.

It is an important feature of this invention that the silicate and hydroxyethyl cellulose work together to form a unique dry film coating which is not excessively water soluble and has good shelf life, which is not brittle at cold forming temperatures, and which is applied from a mixture which has a relatively low viscosity. A further advantage of the lubricating composition of this invention is that even though hydroxyethyl cellulose softens at about 275° F (135° C) and decomposes at about 400° F (204° C), the composition can be used for warm and hot forming processes which are generally performed at higher temperatures and also for multistep cold forming during which the workpiece may reach higher temperatures. At elevated temperatures, the sodium silicate is thermally stable, and, although the hydroxyethyl cellulose may decompose and be evolved, the silicate is no longer brittle and serves to bond the $MoS_2$ to the metal for hot forming operations.

The dry film coating of this system, although of very low water solubility, can readily be removed by a hot (about 160° to 190° F or 71 to 88° C) alkaline cleaning solution which facilitates cleaning the final product pieces.

Natrosol 250 LR hydroxyethyl cellulose is subject to biological attack when kept in solution over an extended period of time. Therefore, a preservative or biocide is preferably added to prevent decomposition. A suitable biocide is one which preserves the hydroxyethyl cellulose and does not impair the lubricating composition. Pine oil made and sold under the designation Hercules Yarmor 302 at a concentration of about 0.1% was effective. The pine oil also functioned as a defoaming agent to offset the tendency of the bath containing the Natrosol product to foam when mixed. When other hydroxyethyl cellulose compositions are used, suitable biocides and defoaming agents should only be added as necessary.

The above ingredients are combined to form a lubricant bath with the component concentrations being adjusted so as to give a desired final dry film coating measured in terms of the coating density which is the amount of lubricant per unit area of substrate surface. Preferably, the concentration of $MoS_2$ in these coatings should be about 75 weight percent. Higher $MoS_2$ concentrations, with corresponding lower concentrations of the bonding agents, can be used as long as adequate coating density and adhesive strength can be maintained. Coatings with lower $MoS_2$ concentrations can be tolerated, provided there is enough $MoS_2$ powder to lubricate adequately without having to put too thick a coating on the surface. The preferred coating density is about 10 to 15 mgs/in$^2$ (1.6 to 2.3 mgs/cm$^2$), with densities of about 3 to 30 mgs/in$^2$ (0.5 to 4.6 mgs/cm$^2$) being acceptable. Coatings of lower density tend to give inadequate lubrication, while those of higher density tend to adhere poorly and may cause sizing problems because of their thickness.

The process of this invention comprises applying one or more coats of the composition of this invention to a metallic workpiece, and then drying the workpiece to leave a dry film coating. Preferably, the workpiece is also dried between successive coatings. A preferred way to dry the workpiece is to blow ambient air over the coated surfaces at a rate which does not disturb the film.

As an example of this invention, the following ingredients were combined in a tank:

| | Weight lbs. (kgs.) | w/o |
|---|---|---|
| $MoS_2$ | 301.1 (136.6) | 19 |
| Sodium Silicate Soln.* | 159.3 (72.3) | 10** |
| Hydroxyethyl Cellulose | 17.5 (7.9) | 1 |
| Pine Oil | 1.6 (0.7) | 0.1 |
| Water | 1113.5 (505.1) | 69.9 |
| | 1593.0 (722.6) | 100.0 |

*RU solution is about 47.05 w/o solutes.
**This is equivalent to about 4.7 w/o dissolved silicate in the bath.

To ensure homogeneity, the bath was continuously recirculated. Coils of stainless steel wire feedstock of various diameters from 0.077 inches to 0.480 inches (0.196 to 1.22 cm), and with variations in surface smoothness and cleanliness were cleaned with acid to remove oxides and foreign matter. The acid was then washed off the coils before dipping to avoid acidifying the bath which was maintained at a pH of about 11 to 13, since lowering the pH may cause some of the components to precipitate or agglomerate.

The coils were immersed into the bath, with no required residence time as long as each coil was thoroughly wetted, and with care not to touch the coils to the sides or bottom of the tank. The coils were spread as much as possible to allow maximum surface coverage. After dipping, the coils were allowed to drain over the tank for a short time, about fifteen seconds was adequate, and then dried, using forced ambient air to accelerate the drying time. Heated air can be used, but care must be taken to dry the coils only until the silicate reaches hydration equilibrium, at about 9 to 11 w/o water for the RU sodium silicate. Further drying with heated air will embrittle the silicate and possibly cause cracking or flaking of the coating in cold working. It was found that by discontinuing the drying when the coils seemed visibly dry, over-drying was avoided.

Once the coils were visibly dry, they were rotated 180° for the purpose of changing the drainage patterns and altering loop contact points, and then dipped and dried a second time by the same method. Following this procedure, additional dips could also be made.

The resultant coating densities ranged from about 8.36 to 18.29 mgs/in$^2$ (1.30 to 2.83 mgs/cm$^2$), averaging at about 14 mgs/in$^2$ (2.2 mgs/cm$^2$). This feedstock was then used in a variety of cold working operations in which the lubricant adhered to the substrate even in multistage operations while providing consistently good lubrication.

As another example of this invention, metallic workpieces were coated by a single stage coating process. Clean workpieces were dipped in a lubricant bath and air dried. The bath for this example comprised:

| | w/o |
|---|---|
| $MoS_2$ | 24 |
| Sodium Silicate Soln. | 10.5 |
| Hydroxyethyl cellulose | 2.5 |
| Pine oil | 0.1 |

with the balance essentially water and incidental impurities, the silicate solution content being equivalent to about 4.9 w/o dissolved silicate. These workpieces were adequately coated with a well-adhered film.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. A composition for forming a dry lubricating film on metallic workpieces, comprising powdered $MoS_2$, soluble silicate wherein the silicate comprises silicon dioxide and an oxide selected from the group consisting of sodium oxide and potassium oxide, hydroxyethyl cellulose, and the balance water.

2. The composition of claim 1 containing about 5 to 30% powdered $MoS_2$.

3. The composition of claim 2 containing about 10 to 30% powdered $MoS_2$.

4. The composition of claim 1 containing about 0.6 to 12% soluble silicate.

5. The composition of claim 4 wherein the ratio by weight of silicon dioxide to oxide is more than about 1.5 and less than about 4.

6. The composition of claim 1 containing about 0.2 to 3% hydroxyethyl cellulose.

7. The composition of claim 1 containing about 5 to 30% powdered $MoS_2$, about 0.6 to 12% soluble silicate wherein the ratio by weight of silicon dioxide to oxide is more than about 1.5 and less than about 4, about 0.2 to 3% hydroxyethyl cellulose.

8. The composition as set forth in claim 1 further comprising a biocide.

9. The composition of claim 8 wherein said biocide is pine oil.

10. The composition of claim 1 wherein said powdered $MoS_2$ has an average particle size of less than about 0.45 micron and a typical average surface area of more than about 13.0 square meters per gram.

11. The composition of claim 7 wherein said powdered $MoS_2$ has an average particle size of less than about 0.45 micron and a typical average surface area of more than about 13.0 square meters per gram.

12. The composition of claim 11 wherein the hydroxyethyl cellulose is a nonionic water-soluble polymer of the general structure:

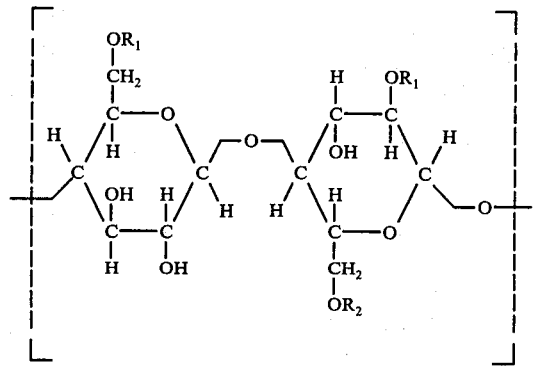

in which $R_1$ is $=C_2H_4=O=C_2H_4OH$ and $R_2$ is $=C_2H_4$-OH.

13. The composition of claim 12 wherein the hydroxyethyl cellulose is treated to provide faster dispersion and easier dissolving in water.

14. The composition of claim 13 wherein a 5% aqueous solution of the hydroxyethyl cellulose has a Brookfield Viscosity at 25° C of 75 to 150 centipoises.

15. The composition of claim 14 further comprising pine oil as a biocide and a defoaming agent.

16. The composition of claim 15 wherein the oxide is sodium oxide and the ratio by weight of silicon dioxide to sodium oxide is about 2.40.

17. The composition of claim 16 comprising about 24% powdered $MoS_2$, about 4.9% soluble silicate, about 2.5% hydroxyethyl cellulose, about 0.1% pine oil.

18. The composition of claim 16 comprising about 19% powdered $MoS_2$, about 4.7% soluble silicate, about 1% hydroxyethyl cellulose, about 0.1% pine oil.

19. A method of applying the composition of claim 1 to a metallic workpiece comprising the steps of coating the workpiece with said composition and then drying the workpiece.

20. A method of applying the composition of claim 7 to a metallic workpiece comprising the steps of coating the workpiece with said composition and then drying the workpiece.

21. A method of applying the composition of claim 15 to a metallic workpiece in which the workpiece is coated by immersing it in a continuously mixed bath consisting essentially of said composition and then drying the workpiece.

22. The method of claim 21 wherein the workpiece is dried by means of a forced air stream.

23. The method of claim 22 wherein the composition contains 10 to 30% powdered $MoS_2$.

24. The method of claim 23 wherein the oxide is sodium oxide and the ratio by weight of silicon dioxide to sodium oxide is about 2.40.

25. The method of claim 24 wherein the bath contains about 24% powdered $MoS_2$, about 4.9% soluble silicate, about 2.5% hydroxyethyl cellulose, about 0.1% pine oil.

26. The method of claim 21 which, after drying the workpiece, further comprises the steps of rotating the workpiece 180°, then immersing the workpiece in the bath a second time, and drying a second time.

27. The method of claim 26 wherein the drying is by means of a forced air stream.

28. The method of claim 27 wherein the oxide is sodium oxide and the ratio by weight of silicon dioxide to sodium oxide is about 2.40.

29. The method of claim 28 wherein the bath contains about 19% $MoS_4$, about 4.7% soluble silicate, about 1% hydroxyethyl cellulose, about 0.1% pine oil.

30. The method of claim 29 wherein the metallic workpiece is a coil of wire.

31. The method of claim 30 wherein the wire is composed of stainless steel.

32. A metallic workpiece coated with a film formed from the composition of claim 1.

33. A metallic workpiece coated with a film formed from the composition of claim 7.

34. A metallic workpiece coated with a film formed from the composition of claim 15.

* * * * *

UNITED STATES PATENT OFFICE

CERTIFICATE OF CORRECTION

PATENT NO. 4,088,585

DATED May 9, 1978

INVENTOR(S) William L. Karpen

It is certified that error appears in the above-identified patent and that said Letters Patent are hereby corrected as shown below:

Col. 2, line 67, delete "the" second occurrence;

Col. 4, line 17, for "=" read -- - -- at both occurrences;

Col. 8, claim 12, line 1 after diagram, for "=" read -- - -- at four occurrences;

Col. 9, claim 29, line 2, for "$MoS_4$" read -- $MoS_2$ --.

Signed and Sealed this

*Seventeenth* Day of *October 1978*

[SEAL]

*Attest:*

RUTH C. MASON
*Attesting Officer*

DONALD W. BANNER
*Commissioner of Patents and Trademarks*